United States Patent [19]
Tasseron
[11] 4,319,477
[45] Mar. 16, 1982

[54] METHOD AND TOOL FOR PRODUCING A BUSHING STRUCTURE HAVING A POLYGONAL FLANGE

[75] Inventor: Frans A. W. Tasseron, Heemstede, Netherlands

[73] Assignee: Koninklijke Emballage Industrie Van Leer B.V., Amstelveen, Netherlands

[21] Appl. No.: 115,363

[22] Filed: Jan. 25, 1980

[30] Foreign Application Priority Data

Jan. 29, 1979 [NL] Netherlands ..... 7900689

[51] Int. Cl.³ ..... B21D 22/00

[52] U.S. Cl. ..... 72/352; 10/86 A; 10/86 F; 72/474

[58] Field of Search ..... 72/352, 360, 358, 469, 72/474; 10/86 CL, 86 A, 86 F, 85

[56] References Cited

U.S. PATENT DOCUMENTS

| | | | |
|---|---|---|---|
| 1,142,782 | 6/1915 | Carlson | 72/474 X |
| 2,138,404 | 11/1938 | Haas | 10/86 CL |
| 2,157,354 | 5/1939 | Sherman | 10/86 F |
| 2,158,434 | 5/1939 | Schwartz . | |
| 2,205,871 | 6/1940 | Young | 10/86 F X |
| 2,539,899 | 1/1951 | Delaney | 10/86 A |
| 3,001,214 | 9/1961 | Anderson et al. | 10/86 CL X |

FOREIGN PATENT DOCUMENTS 101983 2/1962 Netherlands .

*Primary Examiner*—Leon Gilden
*Attorney, Agent, or Firm*—Stevens, Davis, Miller & Mosher

[57] ABSTRACT

The invention relates to a method and a tool (6,8) for producing a bushing structure (1,2) having a bushing (1) and a polygonal flange (2) said flange initially being formed with a circular circumference (5) having an outer diameter equalling the diameter of the inscribed circle (5) of the polygon to be made whereafter by means of cold deformation the material of the flange at the location of the angles of the polygon to be made is forced to flow outwards by means of a die (8) having projections (9) the inner surfaces (10) of which are steep with respect to the axis of the die and the bottom surface (11) of which run obliquely and arching by upwards and outwards the radial width of said projections decreasing from the center to both sides.

3 Claims, 3 Drawing Figures

METHOD AND TOOL FOR PRODUCING A BUSHING STRUCTURE HAVING A POLYGONAL FLANGE

The invention relates to a method for producing a bushing structure having a polygonal flange. An example of such a bushing structure having a polygonal flange has for instance been disclosed in the U.S. Pat. Spec. No. 1,513,638 and the U.S. Pat. Spec. No. 1,982,145, respectively. Usually such a bushing structure is provided with an internal thread for a screw plug and is used in the wall of a barrel in which a polygonal impression has been made for receiving the polygonal flange. The flange and the impression cooperate in order to keep the bushing in a fixed position when screwing the screw plug in its place.

When producing such a bushing structure having a flange the flange portion will always be made by starting from a blank punched out of sheet metal, whereby in view of technical reasons when machining it is necessary that the dimensions of the blank are somewhat bigger than the final dimensions of the flange portion. Successive machining operations are utilized for forming the bushing and the flange portion and for imparting the correct dimensions whereby the polygonal flange is obtained by punching away the edge portions.

The above described way of manufacture leads to material losses and a principal object of the present invention therefore is to provide a method wherein material losses are avoided.

Punching operations entail the drawback that sharp edges may be formed which detrimentally affect the adhesion of a coating if the bushing is provided with a coating. Sharp edges may be avoided by frequent and accurate maintenance of the punch dies and/or additional operations. The invention furthermore envisages to provide a method in which the development of sharp edges, particularly at the periphery of the polygonal flange portion is completely eliminatd in a more simple manner.

According to the invention this object is attained by initially forming the flange of the bushing structure at an outer diameter substantially equalling the diameter of the inscribed circle of the polygon to be made and subsequently cold working the material of the flange at the location of the angles of the polygon to be made by means of a tool acting transversally on the plane of the flange in order to impart a forced outward flow to the material to an extent that is the largest at the location of the angles and decreases in the direction of the points lying between said angles. Hence the invention is based on the conception of starting from a circular flange of too small a size followed by imparting thereto a polygonal shape by local impression.

Because no punching is utilized this operation is not conducive to sharp edges. Moreover the material is strengthened by the cold working operation.

The bushing portion running from the flange is made by removing a circular center portion from the blank punched out of sheet metal and converting the inner edges into a cylindrical sleeve which at a later step is provided with a screw thread. These are known operations, it being novel however that out of the sheet metal there is punched a blank which is smaller than the blank employed by the known method whereas the final product is just as large.

The tool for applying the invention preferably comprises a cavity formed by a polygonal recess for receiving the flange and a die provided with projections directed towards said cavity at the location of the angles of said recess though within the inscribed circle, the inner surface of said projections being steep, i.e. being parallel to or approximately parallel to the axis of the cavity and die, the bottom surface of said projections running obliquely and archingly upwards and outwards, respectively, and the radial width of said projections decreasing from the center to both sides thereof. In essence a tool is thus forced into the material of the flange at the location of an angle of the polygon to be made said implement having such a shape that the material of the flange is made to flow from the circular shape into the angular shape.

The invention will now be elucidated in further detail with reference to the drawings.

Figure 1:
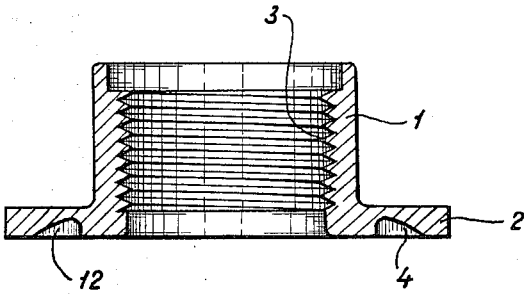
FIG. 1 shows a cross section of the bushing structure provided with a flange to be manufactured.

With reference to FIG. 1 there has been shwon a bushing 1 having a flange 2, which bushing has been provided with an internal screw thread 3. Within the lower side of the flange there have been indicated recesses 4. The bottom view of this flange represented in this figure is of hexagonal shape although it may also have a different number of angles, preferably eight.

Figure 2:
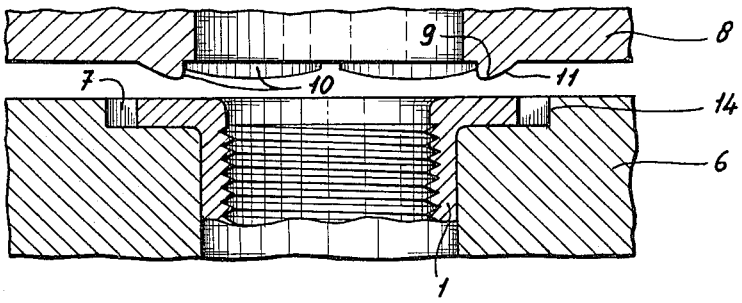
FIG. 2 shows the location of the blank within the cavity.
Figure 3:
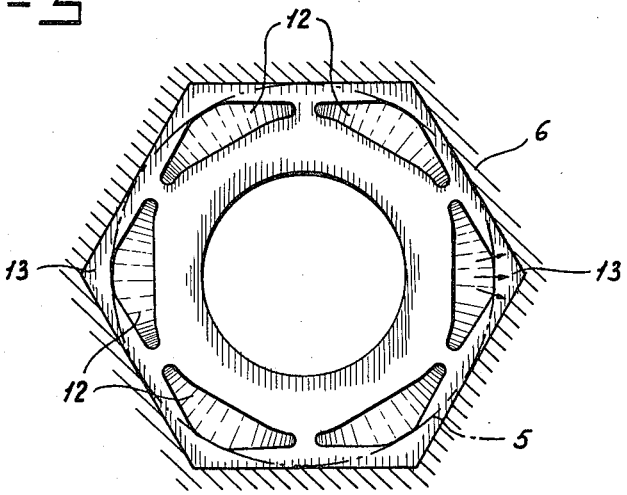
FIG. 3 shows a plan view likewise in diagrammatical representation.

From FIGS. 2 and 3 it is apparent that the blank has a circular shape determined by the periphery 5 of the flange 2.

After stamping the circular blank having the periphery 5 and the manufacture of the bushing portion 1 in a known manner, the work piece as shown in FIG. 2 is positioned within a cavity 6. The flange 2 is received in a recess 7 of the cavity, the height of which corresponds approximately to the thickness of the flange 2. As shown in FIG. 3 this recess 7 is of a hexagonal shape.

The circular flange 2 is forced into the hexagonal shape by means of die 8 provided with projections 9. The dimensions of these projections are such that upon forcing said projections into the material of the flange this material is displaced outwardly in such a manner that the arcuate shape is converted into an angle. Consequently there will have to be displaced a larger amount of material in the centre accompanied by a gradual decrease of the material displacement towards the sides. For effectuating the outward displacement, the projection has an inner face running parallel or substantially parallel, respectively, to the axis of the die, i.e. running steeply in such a manner that the angle with respect to the axis is very acute whereas the bottom surface runs obliquely upwards in an outward direction, which bottom surface may have a flat or arcuate plane. The inner face has been indicated with reference 10, the bottom surface with the reference 11.

In FIG. 1 the shape of the impression has been indicated at 12 in cross section.

From FIG. 3 the shape of the impression in plan view will be apparent. From the latter figure it will also be evident how the radial width of the projections and consequently of the impressions decreases in the middles of the sides of the polygon. Each one of the projections serves to displace such an amount of material that the free space 13 between the periphery 5 of the flange and the side wall 14 of the recess 7 within the cavity 6 will be completely filled, which condition will have to be reached when the cavity 6 and the die 8 come to rest on each other.

It will be clear that the impression does not necessarily have to be made on the lower side of the flange but that such impression may also be made on the upper side or on both sides, respectively.

I claim:

1. A method for producing a bushing structure having a screw thread and a polygonal flange out of a sheet metal blank primarily by forming the bush portion out of the sheet metal blank and thereafter shaping the remaining portion of the plate which portion has become the flange of the bush portion, into the proper polygonal shape, the bushing structure with flange being manufactured from a sheet metal blank of dimensions such that after forming the bush portion the flange has an outer diameter which in principle is equal to the diameter of the inscribed circle of the polygon to be made and subsequently the material of the flange at the location of the corners of the polygon to be made by cold deformation is forced to flow radially outwardly to an extent that is the largest at the location of the corners and decreases in the direction of the points lying between said corners, said method comprising:

placing the flange in a flange receiving die cavity;

pressing a second die in a direction perpendicular to the plane of the flange and into the material of the flange, said second die having projections with an inner surface substantially parallel to the axis of the bushing and having a bottom surface running obliquely and archingly upwards and outwards, the radial width of said projections decreasing from the center to both sides thereof, said projections having a volume which in principle corresponds to the volume of material of the flange that has to be displaced to form the corners.

2. A method of forming a polygonal flange on a bushing starting from a circular flange having the desired finished thickness but of too small a diameter and expanding selected portions of that flange outwardly by local impression to form corners thereof, said method comprising:

placing a bushing with a central threaded portion and a generally circular flange into a cavity of a first die, said cavity having a depth approximately equal to the flange thickness and an outer shape of the desired polygon;

pressing a second die against at least the exposed face of the flange so as to radially outwardly displace selected portions of the flange without substantial axial displacement of any portion and without substantial radial displacement of portions of said flange between said selected portions, said second die having a plurality of projections, each projection being of generally triangular shape at its base and having a steep inner surface generally parallel to the axis of the cavity and an outer surface running obliquely and archingly radially outwards to the base thereof, said projections having a volume generally corresponding to the volume of material of the flange that is to be displaced to form the corners of said polygon, the corners projecting beyond the circle of the flange prior to displacement of the material and the portions of the flange between said corners being generally tangential to that circle.

3. A tool for forming a polygon from a circular workpiece of deformable material comprising:

a first die having a cavity of a depth approximately equal to the thickness of said workpiece and an outer shape of the desired polygon, the flat faces of the polygon being tangential to the circle of the workpiece;

a second die facing said cavity, said dies being mounted for relative movement toward and away from each other; said second die having a plurality of projections directed towards said cavity, each said projection being generally triangular at its base and having a steep inner surface generally parallel to the axis of the cavity and an outer surface running obliquely and archingly radially outwards to the base thereof, said projections having a volume generally corresponding to the volume of material to be displaced to form the corners of said polygon so that after said material is displaced the corners of the workpiece project beyond the original circle thereof and the portions of the workpiece between said corners are still generally tangential to that circle without any substantial axial compression of said workpiece.

* * * * *